US006808020B2

(12) United States Patent
Garcia et al.

(10) Patent No.: US 6,808,020 B2
(45) **Date of Patent: *Oct. 26, 2004**

(54) DEBRIS-FREE VALVE APPARATUS AND METHOD OF USE

(75) Inventors: Christian D. Garcia, Pearland, TX (US); Stephane J. Virally, Houston, TX (US); Steven L. Anyan, Sugar Land, TX (US); Patrick W. Bixenman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/929,499

(22) Filed: Aug. 14, 2001

(65) Prior Publication Data

US 2002/0079104 A1 Jun. 27, 2002

Related U.S. Application Data

(63) Continuation-in-part of application No. 09/754,464, filed on Jan. 4, 2001.

(60) Provisional application No. 60/254,400, filed on Dec. 8, 2000.

(51) Int. Cl.[7] ..... E21B 34/14; E21B 43/12

(52) U.S. Cl. ..... 166/373; 166/333.8; 166/334.1

(58) Field of Search ..... 137/68.15, 68.16, 137/68.17, 527; 166/317, 332.1, 332.8, 334.1, 373

(56) References Cited

U.S. PATENT DOCUMENTS 3,990,511 A * 11/1976 Gazda ..... 166/332.1
4,378,842 A * 4/1983 Patel ..... 166/278
4,411,316 A 10/1983 Carmody ..... 166/323
4,531,587 A 7/1985 Fineberg ..... 166/332
4,597,445 A 7/1986 Knox ..... 166/319

(List continued on next page.)

FOREIGN PATENT DOCUMENTS

GB 2369842 6/2002
WO WO 97/28349 8/1997 ..... E21B/34/10

OTHER PUBLICATIONS

U.S. patent application Ser. No. 09/302,974, filed Apr. 30, 1999, entitled "Full Bore Set Down Tool Assembly for Gravel Packing a Well," by Michael J. Foster, Steven L. Anyan and H. Steven Bissonnette.

(List continued on next page.)

*Primary Examiner*—David Bagnell
*Assistant Examiner*—Brian Halford
(74) *Attorney, Agent, or Firm*—Williams, Morgan & Amerson, P.C.; Jeffrey E. Griffin; Brigitte Jeffery Echols

(57) ABSTRACT

The present invention provides an apparatus for use in completing a subterranean zone penetrated by a wellbore. One aspect of the invention comprises a housing member with a longitudinal bore and a valve member located within the housing member that is movable between open and closed positions. A sliding sleeve having a longitudinal bore is disposed within the housing member and can move between an upper position and a lower position. Attached to the sliding sleeve is a seating element where the valve member can seat. When the sliding sleeve is in the lower position, the valve member is held in the open position and communication is established between the longitudinal bore of the housing above and below the valve member. When the sliding sleeve is in the upper position, the valve member is held in the closed position and communication between the longitudinal bore of the housing above and below the valve member is restricted.

51 Claims, 8 Drawing Sheets

U.S. PATENT DOCUMENTS

| | | | | | |
|---|---|---|---|---|---|
| 4,624,315 | A | | 11/1986 | Dickson et al. | 166/323 |
| 4,838,355 | A | | 6/1989 | Leismer et al. | 166/375 |
| 4,951,753 | A | | 8/1990 | Eriksen | 166/375 |
| 4,976,317 | A | | 12/1990 | Leismer | 166/321 |
| 5,249,630 | A | | 10/1993 | Meaders et al. | 166/373 |
| 5,465,786 | A | * | 11/1995 | Akkerman | 166/323 |
| 5,918,585 | A | * | 7/1999 | Blanchard | 124/20.1 |
| 6,220,353 | B1 | | 4/2001 | Foster et al. | 166/278 |
| 6,328,109 | B1 | * | 12/2001 | Pringle et al. | 166/373 |
| 6,508,309 | B1 | * | 1/2003 | French | 166/323 |

OTHER PUBLICATIONS

U.S. Provisional application Ser. No. 60/254,400, filed Dec. 8, 2000, entitled "Debris Free Valve Apparatus," by Christian D. Garcia, Stephane J. Virally, Steve L. Anyan and Patrick W. Bixenman.

* cited by examiner

DEBRIS-FREE VALVE APPARATUS AND METHOD OF USE

This application is a continuation in part of U.S. Non-Provisional Application No. 09/754,464, filed Jan. 4, 2001 which claims the benefit of U.S. Provisional Application No. 60/254,400, filed Dec. 8, 2000.

BACKGROUND OF THE INVENTION

1. Field of the Invention

This invention relates to the field of completing wellbores in subterranean zones and more specifically to downhole valves.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

The completion can include operations such as the perforating of the wellbore casing, acidizing and fracturing the producing formation, and gravel packing the annulus area between the production tubulars and the productive formation.

A flapper valve device is frequently used in a well completion. The flapper valve device is typically included in the production tubular string and used in conjunction with a packer element. The packer element provides a seal in the annular area between the tubular string and wellbore wall. The valve is held open during the well completion operations by an inserted wash pipe. When the wash pipe is removed from the bore of the valve, the valve closes and prevents communication between the completed formation and the wellbore above the valve and packer. Use of this type of device enables additional work to be performed in the well, such as the completion of additional producing zones, without harming the previously completed formation. To initiate production from the formation, the flapper valve device is broken into pieces. The valve is broken either by applying a pressure differential across the valve sufficient to fracture the valve element or by a mechanical means such as using impact jars run on wireline or a percussion drill utilizing coiled tubing.

In vertical wells, the valve pieces will fall to the bottom of the well or inside the gravel pack screens or any extensions that may be attached. Production from the zone can then proceed without the restriction of the valve device.

In horizontal well completions, the debris from the broken valve device can remain within the producing section of the well. This can be problematic due to the possibility of the debris flowing with the produced fluids or becoming an obstacle to later work within the wellbore.

There is a need for an alternative device that can be used when performing well completion operations that will not leave debris within the wellbore.

SUMMARY OF THE INVENTION

The present invention provides an apparatus for use in completing a subterranean zone penetrated by a wellbore.

One aspect of the invention is an apparatus that comprises a housing member with a longitudinal bore, an inner diameter, and a valve member located within the housing member that is movable between open and closed positions. A sliding sleeve having a longitudinal bore is disposed within the housing member and can move between an upper position and a lower position. Attached to the sliding sleeve is a seating element where the valve member can seat. When the sliding sleeve is in the lower position, the valve member is held in the open position and communication is established between the longitudinal bore of the housing above and below the valve member. When the sliding sleeve is in the upper position, the valve member is held in the closed position and communication between the longitudinal bore of the housing above and below the valve member is restricted.

The seating element can be of a circular shape and is disposed within the longitudinal bore of the housing member. The sliding sleeve can include a contact surface that contacts the valve member and holds the valve member open when the sliding sleeve is in the lower position. The housing member can comprise a first segment and a second segment, the first segment having a smaller inner diameter than the second segment.

In one embodiment the valve member comprises a flapper type valve that is hinged on one side and located within the larger second segment of the housing member. When the valve member is in its open position, the opening through the longitudinal bore of the second segment can be at least as large as the inner diameter of the first segment. The valve member can also comprise a torsion spring member that urges the valve member towards a location between the open position and the closed position. When the sliding sleeve is in the upper position, the torsion spring member urges the valve member to seat onto the seating element. When the sliding sleeve is between the upper position and the lower position, and the contact surface is not in contact with the valve member, the torsion spring member urges the valve member to be located between the open position and the closed position and to protrude into the longitudinal bore of the second segment.

The apparatus can further comprise a spring element disposed within the housing that is movable between a compressed position and an expanded position. The spring element urges the sliding sleeve into the lower position. When the sliding sleeve is in the upper position the spring element will be in its compressed position.

In one embodiment the apparatus can comprise a mandrel element disposed within the longitudinal bore of the housing, capable of being in an upper position and a lower position. The mandrel element can be rigidly connected to the sliding sleeve.

In another embodiment a shear sleeve member can be disposed within the longitudinal bore of the housing and capable of being in an upper position and a lower position. The shear sleeve member further comprises at least one locking element. When the shear sleeve member is in its upper position, the locking element prevents the shear sleeve member from moving longitudinally relative to the housing member. The shear sleeve member can further comprise at least one shear element.

The apparatus can further comprise a latching element located within the longitudinal bore of the housing and capable of being in a latched or unlatched configuration and in an upper position and a lower position. A latching element can be connected to the sliding sleeve and to the mandrel element. The latching element is connected to the shear sleeve member with at least one shear element. When the shear sleeve member is in its upper position and the latching element is in its upper position and connected to the shear sleeve member, a downward force can be exerted on the mandrel element that will move the mandrel element downward, causing the mandrel element to contact the latching element and forcing the shear element to break and disconnect the latching element from the shear sleeve member. This downward force on the mandrel element can result from hydraulic pressure being applied upon the valve member, this pressure force being transmitted through the sliding sleeve to the mandrel element. When the latching element is disconnected from the shear sleeve member and is in its lower position, the latching element is in its latched configuration and unable to move longitudinally relative to the housing member. When the latching element is in its latched configuration, the sliding sleeve will be in its lower position and unable to move longitudinally relative to the housing member, and the valve member will be in its open position.

One particular embodiment of the present invention comprises a housing member having a longitudinal bore, a first segment, a second segment and an inner diameter. The first segment of the housing member has a smaller inner diameter than the second segment. A valve member is disposed within the housing member and is movable between an open position and a closed position. The valve member can be hinged on one side and have a torsion spring member that urges the valve member towards a location between the open position and the closed position. A sliding sleeve can be disposed within the housing member, having a longitudinal bore and movable between an upper position and a lower position. The sliding sleeve also comprises a seating element on which the valve member can seat. The sliding sleeve can also include a contact surface that contacts the valve member and restrains the valve member in the open position when the sliding sleeve is in the lower position. A spring element can also be disposed within the longitudinal bore of the housing, movable between a compressed position and an expanded position, which urges the spring sleeve into its lower position.

A mandrel element, capable of being in an upper and lower position is disposed within the longitudinal bore of the housing and is connected to the sliding sleeve. A shear sleeve member, capable of being in an upper and lower position is disposed within the longitudinal bore of the housing and comprises at least one locking element and at least one shear element. A latching element, capable of being in an upper and lower position is disposed within the longitudinal bore of the housing and is connected to the sliding sleeve. The latching element is capable of being in a latched and an unlatched configuration and is connected to the shear sleeve member by at least one shear element. When the sliding sleeve is in the lower position the valve member is held in the open position, which establishes communication between the longitudinal bore of the housing above the valve member and the longitudinal bore of the housing below the valve member. When the sliding sleeve is in the upper position, the valve member is held in the closed position that restricts communication between the longitudinal bore of the housing above the valve member and the longitudinal bore of the housing below the valve member.

When the shear sleeve member is in its upper position, the locking element prevents the shear sleeve member from moving longitudinally relative to the housing member. When the shear sleeve member is in its upper position and the latching element is in its upper position and connected to the shear sleeve element, a downward force can be exerted on the mandrel element. Movement of the mandrel element will contact the latching element and will force the shear element to break and disconnect the latching element from the shear sleeve member. When the latching element is disconnected from the shear sleeve member and is in its lower position, the latching element will be in its latched configuration and unable to move longitudinally relative to the housing member. The latching element will restrain the sliding sleeve in its lower position, unable to move longitudinally relative to the housing member, and the valve member will be held in its open position.

The present invention also provides a method of completing a subterranean zone penetrated by a wellbore. The apparatus as described above is positioned within the wellbore with the sliding sleeve in the lower position holding the valve member open. The sliding sleeve is then moved to its upper position, which holds the valve member in its closed position. This restricts the fluid communication through the longitudinal bore of the housing. A force is then imposed on either the sliding sleeve or the mandrel element such that the mandrel element transmits the force onto the shear element, breaking the shear element. With the shear element broken, the sliding sleeve moves to its lower position and thereby opens the valve member and allows communication through the longitudinal bore of the housing.

In an alternate embodiment of the present invention the apparatus is attached to a gravel pack screen assembly, a packer and a work string prior to being positioned within the wellbore. In a preferred embodiment of the present invention the packer is set and the valve member is held in its open position. A gravel laden slurry is then flowed through the work string, packer and the apparatus. The slurry is placed between the wellbore and the gravel pack screen assembly.

The method can further include the step of disconnecting the work string from the apparatus and the packer after the gravel laden slurry has been placed. Disconnecting the work string will shift the sliding sleeve into its upper position and thereby hold the valve member in its closed position.

In one embodiment of the invention the valve member comprises a disk having a concave surface on one side and a convex surface on the other side. The valve member can be connected to a collar element that is disposed in a collar groove within the housing member. The collar element can have a collar notch that prevents the collar element from rotating within the collar groove.

In another embodiment the housing member comprises a retaining ring that can engage with the sliding sleeve when the sliding sleeve is in its lower position. The retaining ring can restrict movement of the sliding sleeve when the retaining ring is engaged with the sliding sleeve.

In yet another embodiment a spring sleeve is disposed within the housing and movable between an upper position and a lower position. The spring element urges the spring sleeve toward the lower position. The spring sleeve is held in the upper position by at least one shear element that connects the spring sleeve to the housing member.

In one particular embodiment the valve member has a projection, the projection being capable of restricting the rotational movement of the valve member to movement between the open position and the closed position. The valve member can be disposed within and connected to a valve housing creating a valve subassembly. The valve subassembly is disposed within the housing and is capable of rotational movement and limited longitudinal movement within the housing. In this embodiment the sliding sleeve is likewise capable of rotational movement within the housing and the valve subassembly and the sliding sleeve are rotationally linked. The rotational linkage can comprise a guide in the valve subassembly and a groove in the sliding sleeve wherein the guide is disposed within the groove. When the valve member is in its closed position, the valve subassembly is capable of longitudinal movement within the housing. This longitudinal movement is capable of moving the valve member away from the seating element.

In still another embodiment the sliding sleeve further comprises a linking element. When the sliding sleeve is in the upper position the linking element can attach to the is spring sleeve. When the sliding sleeve and the spring sleeve are both in their upper positions and the linking element is attached to the spring sleeve, a downward force can be exerted on the sliding sleeve that will move the sliding sleeve downward. This downward force will cause a downward force on the spring sleeve and force the shear element to break, thus disconnecting the spring sleeve from the housing member. Once the spring sleeve is disconnected from the housing member, the spring element will urge the sliding sleeve towards its lower position.

The sliding sleeve can further comprise a key slot that can include an upper key stop and a lower key stop. The housing member can further comprise a key element that is located within the key slot and restricts the sliding sleeve from rotating. When the sliding sleeve is in its upper position, the key element will contact the lower key stop to restrict further upward movement of the sliding sleeve, and the valve element will be properly spaced out to be in its closed position. When the sliding sleeve is in its lower position, the key element will contact the upper key stop to restrict further downward movement of the sliding sleeve, and the valve element will be properly spaced out to be in its open position.

One particular embodiment of the present invention comprises a housing member having a longitudinal bore, an inner diameter and comprising a retaining ring and a key element. A valve member is disposed within the housing member and is movable between an open position and a closed position. The valve member can have a torsion spring member that urges the valve member towards a location between the open position and the closed position. A sliding sleeve can be disposed within the housing member, having a longitudinal bore and movable between an upper position and a lower position. The sliding sleeve also comprises a seating element on which the valve member can seat. A key slot is located on the sliding sleeve and is in sliding contact with the key element, thus restricting the sliding sleeve from rotating within the housing member. The sliding sleeve can also include a contact surface that contacts the valve member and restrains the valve member in the open position when the sliding sleeve is in the lower position. A spring sleeve can be disposed within the longitudinal bore of the housing, capable of moving between an upper position and a lower position and comprising at least one shear element. A spring element can also be disposed within the longitudinal bore of the housing, movable between a compressed position and an expanded position, that urges the spring sleeve into its lower position.

A linking element is disposed within the longitudinal bore of the housing and is connected to the sliding sleeve. When the sliding sleeve is in the lower position, the retaining ring prevents the shear sleeve member from moving longitudinally relative to the housing member and the valve member is held in the open position which establishes communication between the longitudinal bore of the housing above the valve member and the longitudinal bore of the housing below the valve member. When the sliding sleeve is in the upper position, the sliding sleeve is attached to the spring sleeve by the linking element, the valve member is then held in the closed position that restricts communication between the longitudinal bore of the housing above the valve member and the longitudinal bore of the housing below the valve member. When the sliding sleeve is in its upper position and the linking element is in its upper position and connected to the spring sleeve, a downward force can be exerted on the sliding sleeve, the resulting movement of the sliding sleeve will force the shear element to break which will disconnect the spring sleeve from the housing member. Once the spring sleeve is disconnected from the housing member and is in its lower position, the linking element is attached to the sliding sleeve, the sliding sleeve is in its lower position unable to move longitudinally relative to the housing member, and the valve member is in its open position.

Another embodiment of the invention is a method for completing a subterranean zone penetrated by a wellbore comprising the following steps: positioning an apparatus as described immediately above within the wellbore with the sliding sleeve in the lower position holding the valve member open, moving the sliding sleeve to its upper position, whereby the valve member is held in its closed position and communication through the longitudinal bore of the housing is restricted, and imposing a force on the sliding sleeve such that the sliding sleeve transmits the force onto the shear element, breaks the shear element and allows the sliding sleeve to move to its lower position, thereby opening the valve member and allowing communication through the longitudinal bore of the housing.

In an alternate embodiment of the present invention the apparatus is attached to a gravel pack screen assembly, a packer and a work string prior to being positioned within the wellbore. In a preferred embodiment of the present invention the packer is set and the valve member is held in its open position. A gravel laden slurry is then flowed through the work string, packer and the apparatus. The slurry is placed between the wellbore and the gravel pack screen assembly.

The method can further include the step of disconnecting the work string from the apparatus and the packer after the gravel laden slurry has been placed. Disconnecting the work string will shift the sliding sleeve into its upper position and thereby hold the valve member in its closed position.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
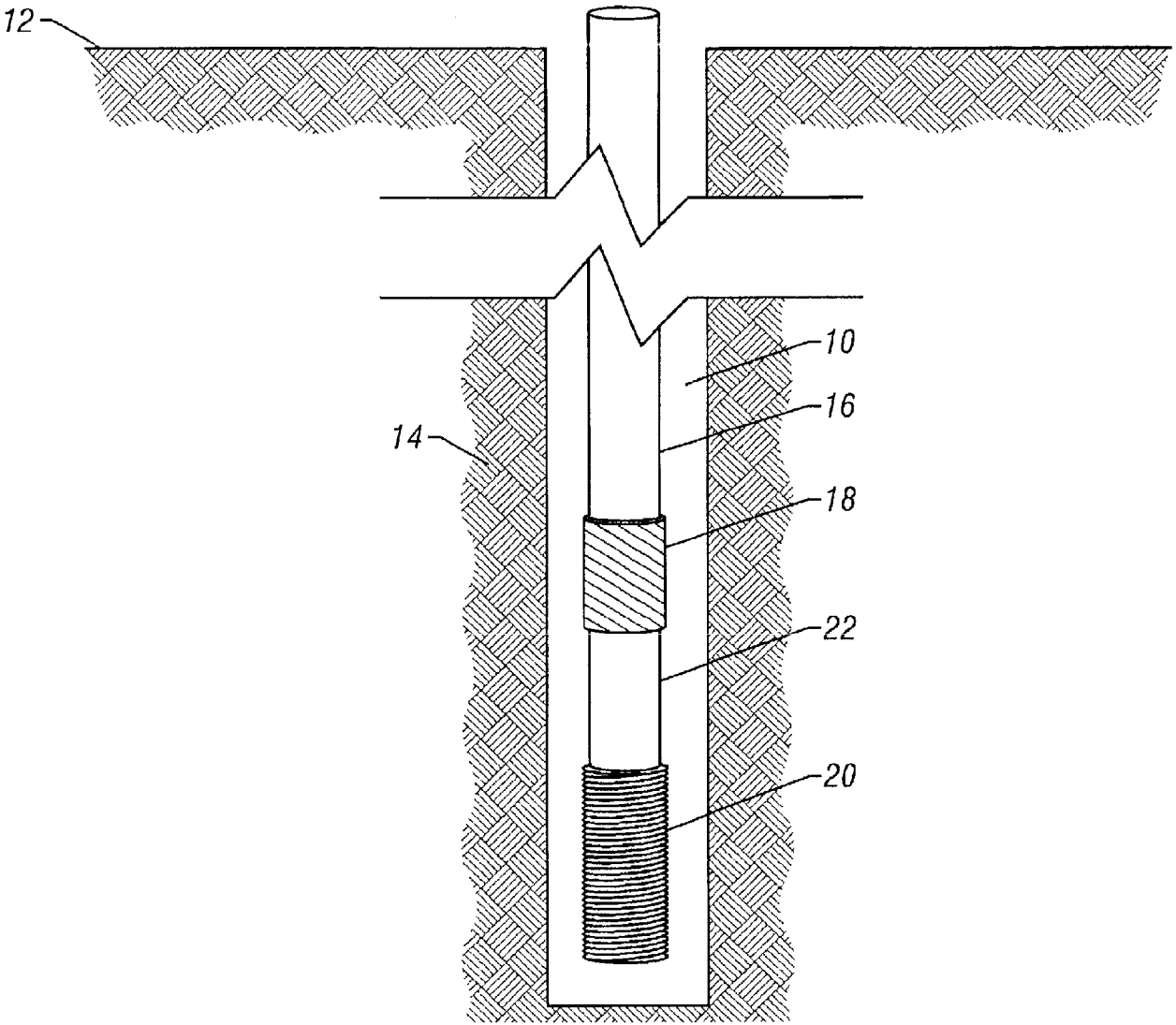
FIG. 1 is a schematic of the present invention used in a wellbore completion.

FIG. 1 illustrates a wellbore 10 drilled from the surface 12 into a subterranean formation 14. Inserted into the wellbore 10 is a tubular string 16, such as a work string or production tubing, a packer 18, a gravel pack screen assembly 20 and the valve apparatus 22 of the present invention.

Figure 2A:
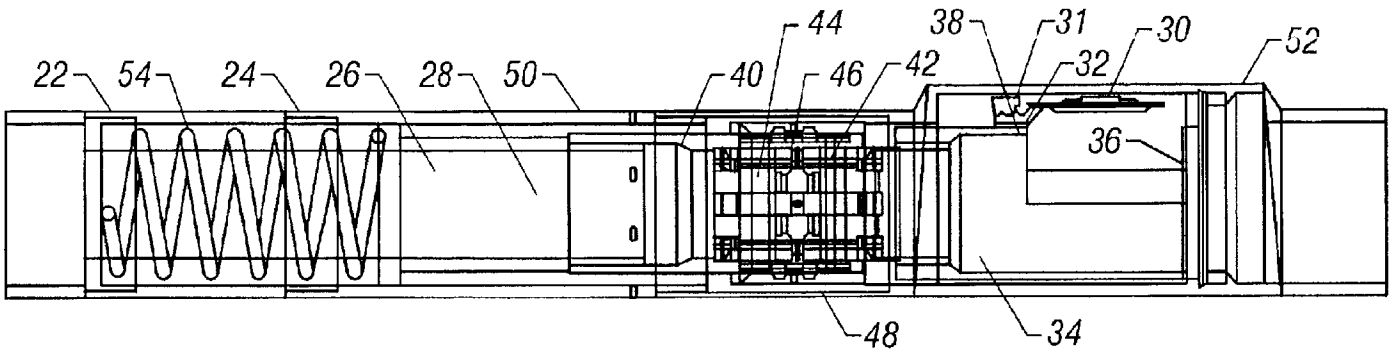
FIGS. 2A–2C illustrate an embodiment of the invention in its three configurations, initial open position, closed position and final open position.
Figure 2B:
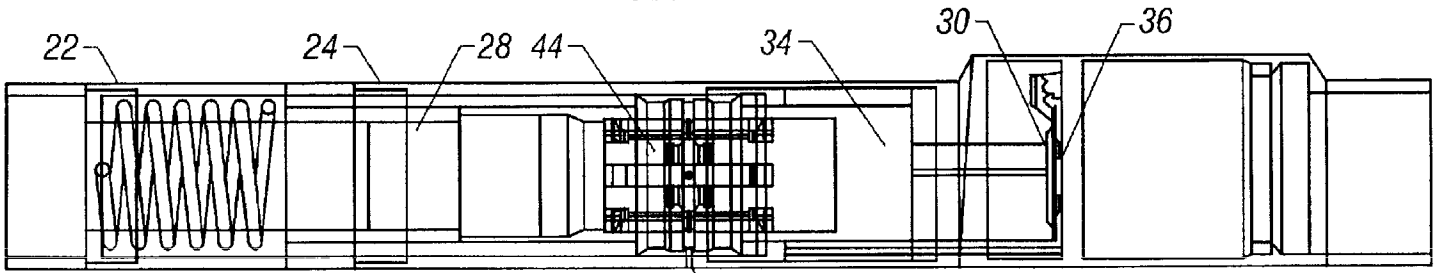
Figure 2C:
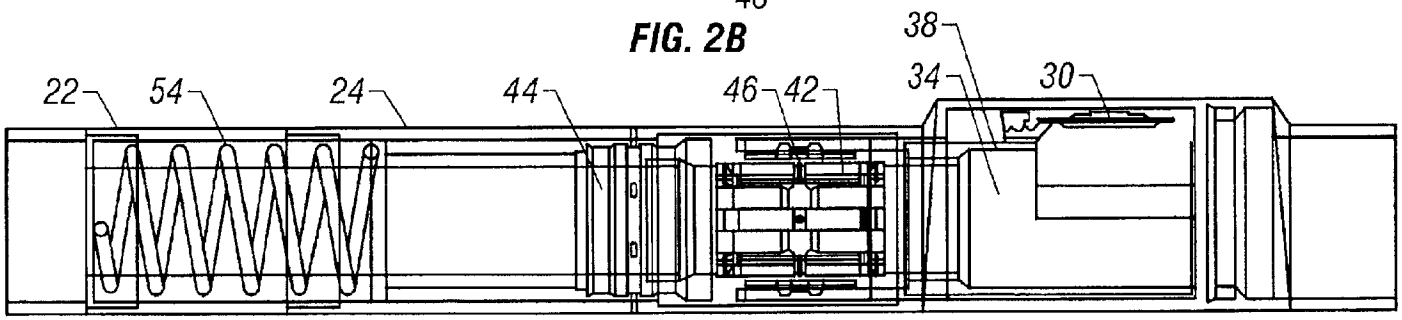

FIGS. 2A, 2B and 2C illustrate one embodiment of the present invention.

FIG. 2A shows the valve apparatus 22 comprising a housing member 24 having an inner diameter 26 that defines a longitudinal bore 28. A valve member 30 is located within the valve apparatus 22, is attached to the housing member 24 by a hinge mechanism 31 and has a torsion spring member 32 that acts to urge the valve member 30 towards a position between fully open and fully closed. A sliding sleeve 34 is disposed within the housing member 24 and includes a seating element 36 on which the valve member 30 can seat. The sliding sleeve 34 is movable within the valve apparatus 22 between an upper and a lower position. The sliding sleeve 34 further comprises a contact surface 38 that will contact the valve member 30 when the sliding sleeve 34 is in the lower position. Connected to the sliding sleeve 34 is a mandrel element 40 and a latching element 42. A shear sleeve member 44 is capable of being in an upper and lower position and is connected to the latching element 42 by use of at least one shear element 46 and further comprises a locking element 48. The shear element can comprise a shear pin, a shear screw, or other types of shear mechanisms that are known by those skilled in the art. In this embodiment of the invention, the housing member 24 comprises a first segment 50 and a second segment 52. The second segment 52 has a larger diameter than the first segment 50, and is therefore able to contain the valve member 30 while still maintaining the same inner diameter 26 of the longitudinal bore 28 as the rest of the housing member 24. A spring element 54 is located within the housing member 24 and is movable between a compressed position and an expanded position and can urge the sliding sleeve 34 toward the lower position.

In this application the term spring element is used to describe a type of actuator. The spring element may be replaced by other types of actuators such as gas biasing chambers, control lines, or other known methods of actuating downhole equipment. The term spring element as used in this application should be construed as comprising any of these actuator types.

FIG. 2A illustrates the valve apparatus 22 in its initial open configuration where the sliding sleeve 34 is in its lower position and the contact surface 38 is holding the valve member 30 in its open position. The spring element 54 is applying force onto the sliding sleeve 34 urging it towards the lower position.

FIG. 2B illustrates the valve apparatus 22 in its closed configuration where the sliding sleeve 34 is in its upper position and the seating element 36 is seated against the valve member 30. The sliding sleeve 34 is held in the upper position by the locking element 48 of the shear sleeve member 44. The locking element 48 engages with the housing member 24 to keep the shear sleeve member 44 in the upper position. In this configuration fluid communication is restricted and preferably completely prevented, through the longitudinal bore 28 of the valve apparatus 22. The seating element 36 can be made of an elastomer material to facilitate an adequate seal against the valve member 30.

FIG. 2C shows the valve apparatus 22 in its final open configuration. A force exerted on the sliding sleeve 34 breaks the shear element 46 allowing the movement to the position of FIG. 2C. This force can result from imposing a pressure differential across the valve member 30 or by other means such as mechanical jars run on wireline or coiled tubing. The breaking of the shear element 46 enables the latching element 42 to separate from the shear sleeve member 44. The sliding sleeve 34 then moves to its lower position with assistance from the spring element 54. As the sliding sleeve 34 moves downward, the contact surface 38 forces the valve member 30 to open. Once the sliding sleeve 34 is in its lower position, it is held in this final position by the latching element 42 engaging with the housing member 24 and by the force imposed from the spring element 54. The valve apparatus 22 remains in this final open configuration until removed from the wellbore 10.

Figures 3A, 3B, 3C:
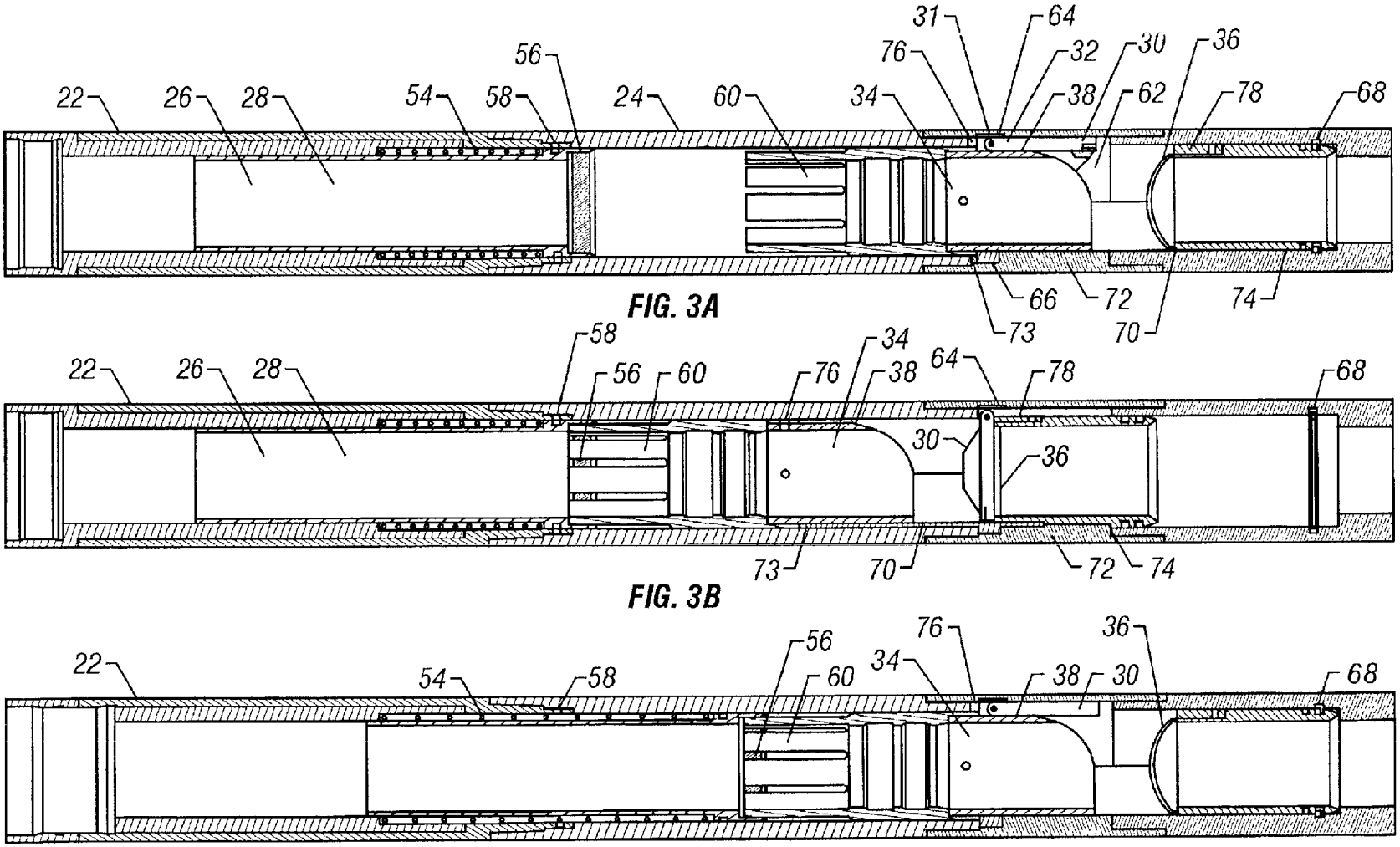
FIGS. 3A–3C illustrate an alternate embodiment of the invention in its three configurations, initial open position, closed position and final open position.

FIGS. 3A, 3B and 3C show an alternate embodiment of the present invention.

FIG. 3A illustrates the valve apparatus 22 in its initial open configuration where the sliding sleeve 34 is in its lower position and the contact surface 38 is holding the valve member 30 in its open position. In this embodiment of the invention the spring element 54 is contained within a spring sleeve 56 that is disposed within the housing member 24. The spring sleeve 56 can move between upper and lower positions and can be held in the upper position by a shear element 58. The sliding sleeve 34 comprises a linking element 60 that is capable of engaging with the spring sleeve 56. In this embodiment, the valve member 30 is curved with a concave surface on one side and a convex surface on the other side. The valve member 30 is shaped such that it is contained within a recess area 62 of the housing member 24 when in the open position. This shaped valve member 30 enables the valve apparatus 22 to keep the inner diameter 26 throughout the longitudinal bore 28 above a predetermined minimum size without having segments of differing diameters, as were needed in the embodiments shown in FIGS. 2A–2C. The seating element 36 is attached to the sliding sleeve 34 and is shaped to seat with the valve member 30. The seating element 36 can be made of an elastomer material to facilitate an adequate seal against the valve member 30. The seating element also comprises a seal between the sliding sleeve 34 and the housing member 24. This seal would typically comprise an elastomer in the form of an O-ring.

One embodiment of the invention comprises the valve member 30 being connected to a collar element 64 by a hinge mechanism 31. The valve member 30 can further include a torsion spring member 32 that acts to urge the valve member 30 towards a position between fully open and fully closed. The collar element 64 is positioned within a collar groove 66 located in the housing member 24. The collar element 64 disposed within the collar groove 66 will permit some longitudinal movement of the valve member 30. The amount of longitudinal movement of the valve member 30 is small and is limited to the difference between the width of the collar element 64 and the width of the collar groove 66. This freedom of movement helps to minimize the loading forces exerted on the hinge mechanism 31. The sliding sleeve 34 is retained in the lower position by a retaining ring 68. When engaged with the sliding sleeve 34, the retaining ring 68 will hold the sliding sleeve 34 in the lower position unless an upward force is imposed on the sliding sleeve 34 sufficient to overcome the retaining ring 68. The retaining ring 68 can take the form of numerous devices known in the art, for example, a type of C-ring, a collet type mechanism or retaining clips located around the circumference of the housing member 24. The sliding sleeve 34 is kept from rotating within the housing member 24 by the use of a key slot 70 and a key element 72. The key slot 70 is a groove located in the sliding sleeve 34 that includes an upper key stop 73 and a lower key stop 74. The key element 72 is attached to the housing member 24 and is located within the key slot 70.

FIG. 3B illustrates the present invention in its closed configuration. The sliding sleeve 34 is in its upper position and has been disconnected from the retaining ring 68. The valve member 30 is in its closed position and is seated onto the seating element 36. The valve member 30 and the seating element 36 are kept in alignment by the key element 72 and the key slot 70. The upward movement of the sliding sleeve 34 is prevented beyond the point where the valve element 30 and the seating element 36 are seated by the key element 72 reaching the lower key stop 74. The collar element 64 is urged to the upper shoulder of the collar groove 66 and is restrained from moving downward by its linkage with the valve element 30. The linking element 60 is attached to the spring sleeve 56. In this configuration fluid communication through the longitudinal bore 28 of the valve apparatus 22 is restricted and preferably completely prevented, by the seating of the valve element 30 to the seating element 36 and the seal between the seating element 36 and the housing member 24.

FIG. 3C shows the valve apparatus 22 in its final open configuration. A force exerted on the sliding sleeve 34 breaks the shear element 58 that is retaining the spring sleeve 56, allowing the movement to the position of FIG. 3C. This force can result from imposing a pressure differential across the valve member 30 or by other means such as mechanical jars run on wireline or coiled tubing. The breaking of the shear element 58 enables the spring element 54 to move the spring sleeve 56 to its lower position. The spring sleeve 56 remains attached to the linking element 60 which itself is attached to the sliding sleeve 34. The sliding sleeve 34 moves to its lower position with assistance from the spring element 54. As the sliding sleeve 34 moves downward, the contact surface 38 contacts and opens the valve member 30 to the fully open position. Once the sliding sleeve 34 is in its lower position, it is held in this final position by engaging with the retaining ring 68 and by the force imposed from the spring element 54. The valve apparatus 22 remains in this final open configuration until removed from the wellbore 10.

The valve member 30 as described in the present invention may be used with any well tool using a flapper type valve, such as a safety valve.

The contact surface 38 can comprise a curved surface that will contact the valve member 30 at multiple contact points while the valve member 30 is moving from the closed position to the open position. In this way the forces on the valve member 30 can be located where they will not damage the valve member. An example of potential damage would be if excessive force was located on the hinge element 31, the hinge element 31 or the torsion spring member 32 could be damaged. It is preferable to direct the force from the sliding sleeve 34 to locations on the valve member 30 that are away from the hinge element 31 when possible. This will provide a greater torque to overcome the resisting force of the torsion spring member 32 with the same linear force from the spring element 54.

Figure 4A:
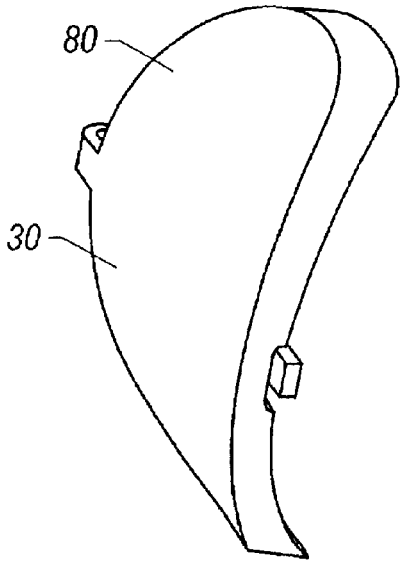
FIGS. 4A–4C illustrate differing views of an embodiment of the valve member.
Figure 4B:
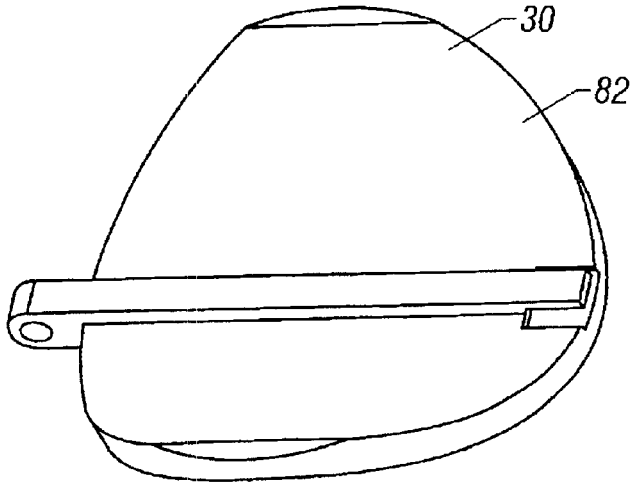
Figure 4C:
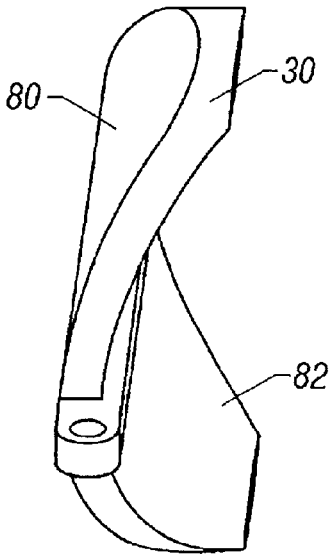

FIGS. 4A–4C show different views of an embodiment of the valve member 30, that has a concave surface on one side and a convex surface on the other side.

FIG. 4A illustrates the convex surface 80 of the valve member 30. The convex surface 80 is the portion of the valve member 30 that will seat with the seating element 36 (as shown in FIGS. 3A–3C).

FIG. 4B shows the concave surface 82 of the valve member 30.

FIG. 4C is a side view of the valve member 30 showing both the convex surface 80 and the concave surface 82.

Figure 5A:
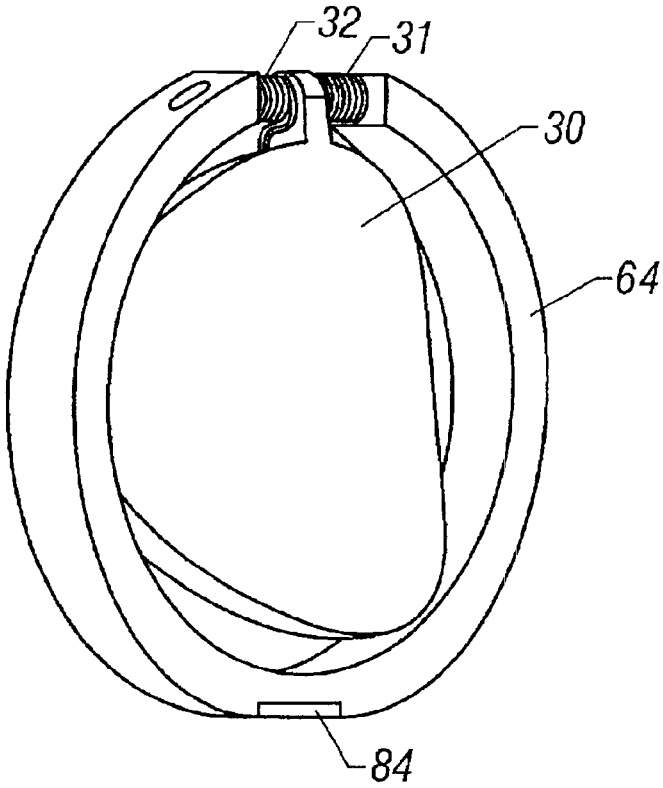
FIGS. 5A–5B illustrate the valve member connected to the collar element.
Figure 5B:
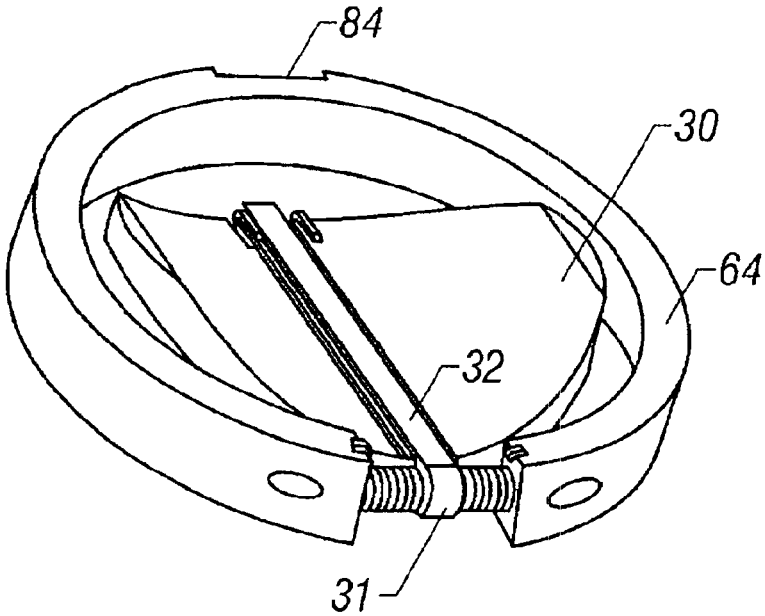

FIGS. 5A and 5B show an embodiment of a valve member 30, hinge mechanism 31, torsion spring member 32, and a collar element 64. The collar notch 84 will fit over a key (not shown) in the housing member 24 and prevent the collar element 64 from rotating within the collar groove 66 when placed within the valve apparatus 22.

Figure 6A:
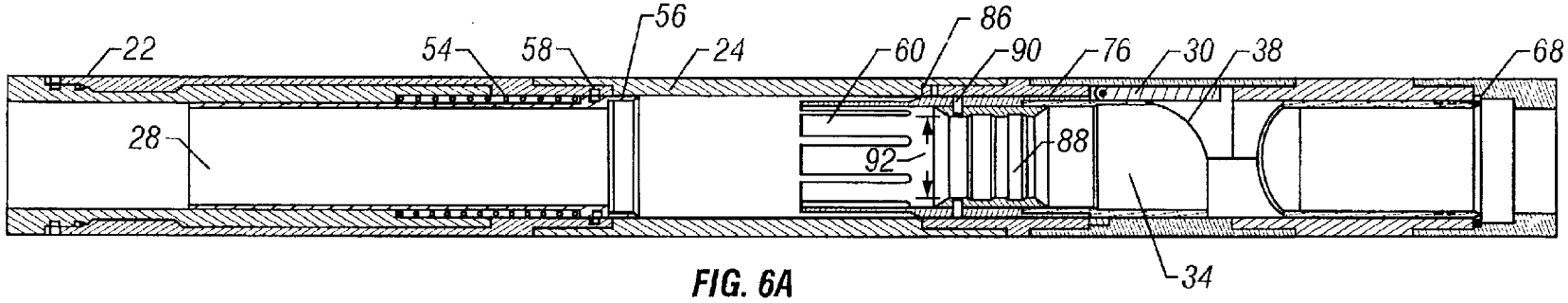
FIGS. 6A–6C illustrate an alternate embodiment of the invention in its three configurations, initial open position, closed position and final open position.
Figure 6B:
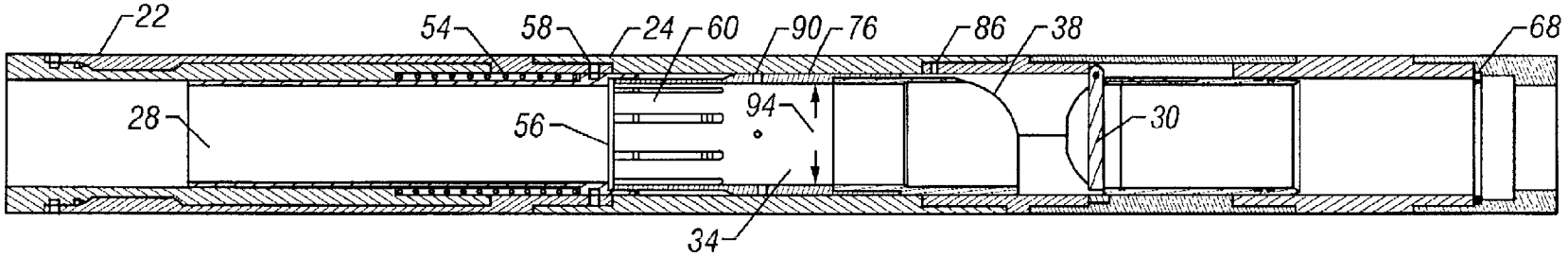
Figure 6C:
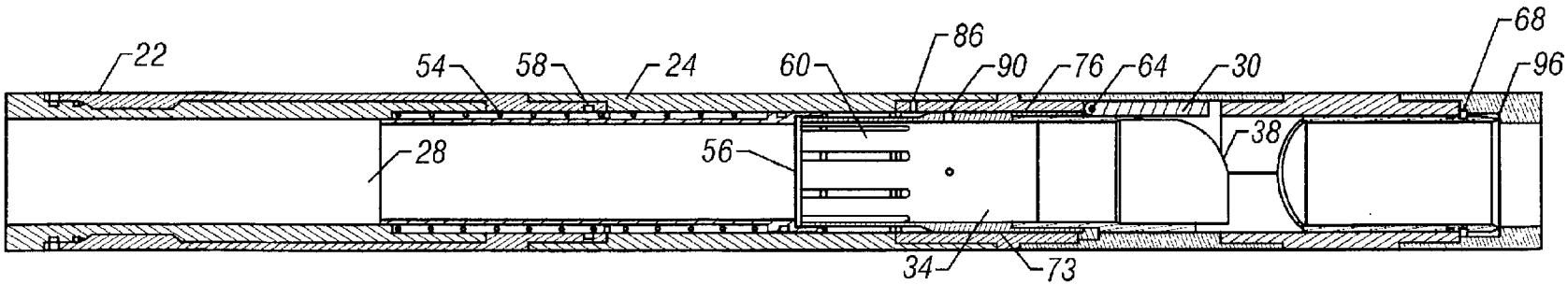

FIGS. 6A, 6B and 6C show an alternate embodiment of the present invention.

FIG. 6A illustrates the valve apparatus 22 in its initial open configuration where the sliding sleeve 34 is in its lower position and the contact surface 38 is holding the valve member 30 in its open position. In this embodiment the sliding sleeve 34 is held in its initial lower position by a shear element 86 that joins the sliding sleeve 34 to the housing member 24. This embodiment further comprises a shearable profile 88 disposed within the sliding sleeve 34 and attached to the sliding sleeve 34 by means of a shear element 90. The shearable profile 88 has an inner diameter 92. The valve apparatus 22 is attached to the tubular string (shown as 16 in FIG. 1) by means of the shearable profile 88. A shifting tool (not shown) on the tubular string can go downward through the shearable profile 88. When the shifting tool is pulled upward it latches into the shearable profile 88. Further upward force will shear the shear element 86 and allow the sliding sleeve 34 to move upward into its upper position.

FIG. 6B illustrates the valve apparatus 22 in its closed configuration after the sliding sleeve 34 has been moved into its upper position. Once the linking element 60 has been attached to the spring sleeve 56 further upward force will shear the shear element 90 and release the shearable profile 88 from the sliding sleeve 34. The shearable profile 88 is then free to be removed from the wellbore with the rest of the tubular string. The shearable profile 88 allows a shifting tool that is a smaller size than what would be needed in embodiments without a removable shearable profile 88. When the shearable profile is removed from the valve apparatus 22, an inner diameter 94 that is larger than the shearable profile inner diameter 92 is obtained resulting in a larger diameter longitudinal bore 28 through the valve apparatus 22.

FIG. 6C shows the valve apparatus 22 in its final open configuration. A force exerted on the sliding sleeve 34 breaks the shear element 58 that is retaining the spring sleeve 56 allowing the movement to the position of FIG. 6C. This force can result from imposing a pressure differential across the valve member 30 or by other means such as mechanical jars run on wireline or coiled tubing. The breaking of the shear element 58 enables the spring element 54 to move the spring sleeve 56 to its lower position. The spring sleeve 56 remains attached to the linking element 60 which itself is attached to the sliding sleeve 34. The sliding sleeve 34 moves to its lower position with assistance from the spring element 54. As the sliding sleeve 34 moves downward, the contact surface 38 contacts and opens the valve member 30 to the fully open position. Once the sliding sleeve 34 is in its lower position, it is held in this final position by engaging with the retaining ring 68 and by the force imposed from the spring element 54. Further downward movement of the sliding sleeve 34 is prevented by a positive stop 96. The valve apparatus 22 remains in this final open configuration until removed from the wellbore 10.

Figure 7A:
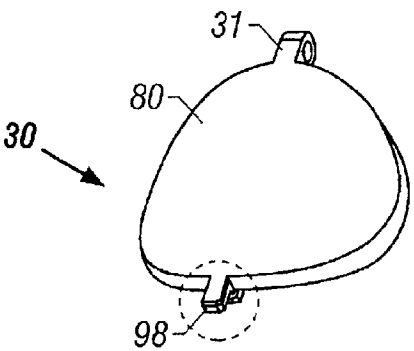
FIGS. 7A–7B illustrate differing views of an alternative embodiment of the valve member.
Figure 7B:
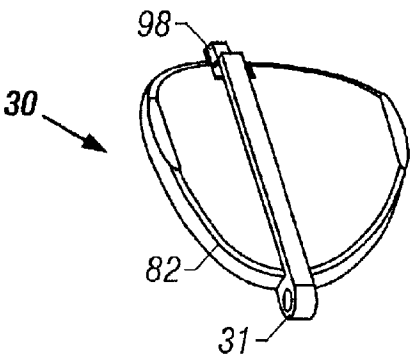

FIGS. 7A–7B show an embodiment of the valve member 30, that has a concave surface 82 on one side and a convex surface 80 on the other side. This particular embodiment comprises a projection 98, that can be referred to as a "tail", that extends from the opposite end of the valve member 30 than the hinge mechanism 31 end. The tail 98 can be used to restrict the rotational movement of the valve member 30 beyond its closed position.

Figure 8A:
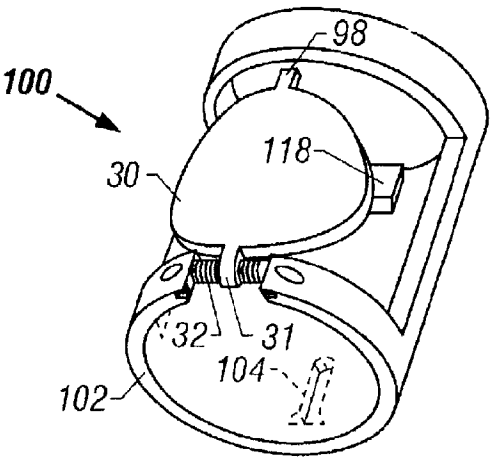
FIGS. 8A–8B illustrate differing perspective views of an alternative embodiment of the valve member connected to a valve housing.
Figure 8B:
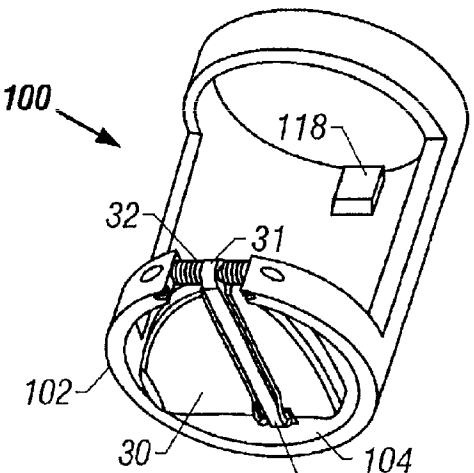

FIGS. 8A and 8B show an alternate embodiment of a flapper subassembly 100 comprising a valve member 30, hinge mechanism 31, torsion spring member 32, and a valve housing 102. A valve stop 104 within the valve housing 102 restrict the movement of the valve member 30 by contact with the tail 98. A guide 118 that will be used for rotational alignment is shown within the valve housing 102.

Figure 9A:
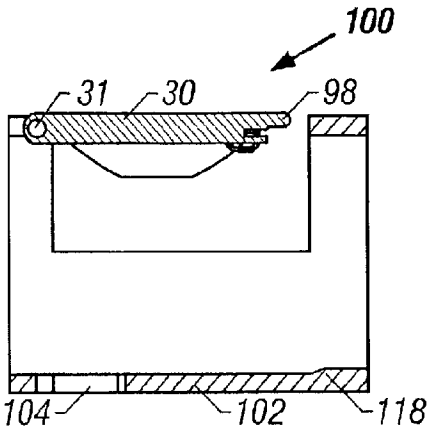
FIGS. 9A–9B illustrate cross-sectional views of the embodiment shown in FIGS. 8A–8B.
Figure 9B:
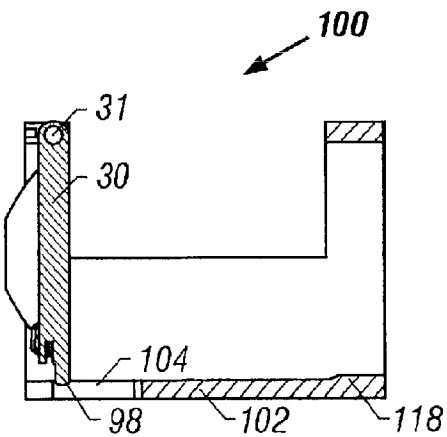

FIGS. 9A and 9B are cross-sectional views of the flapper subassembly 100 in its open and closed positions. FIG. 9B shows the contact of the tail 98 with the valve stop 104 when the valve member 30 is in its closed position.

Figure 10A:
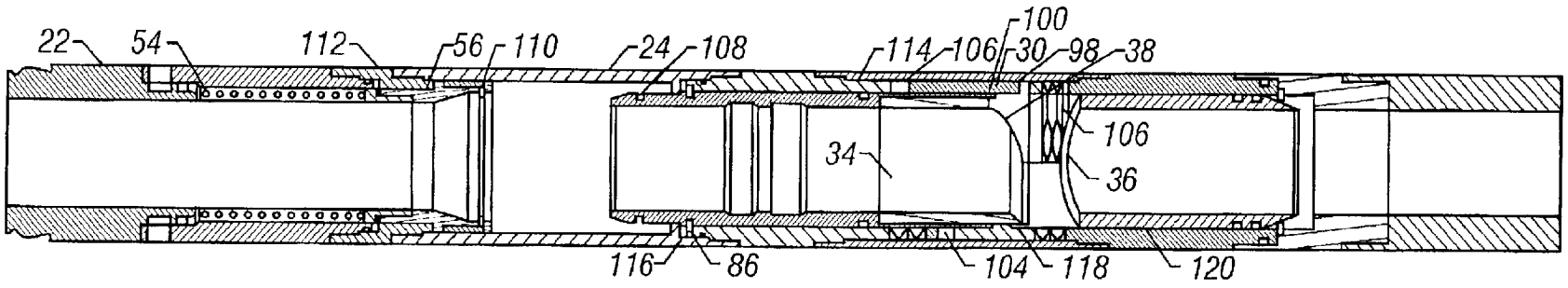
FIGS. 10–10C illustrate an alternate embodiment of the invention in its three configurations, initial open position, closed position and final open position.
Figure 10B:
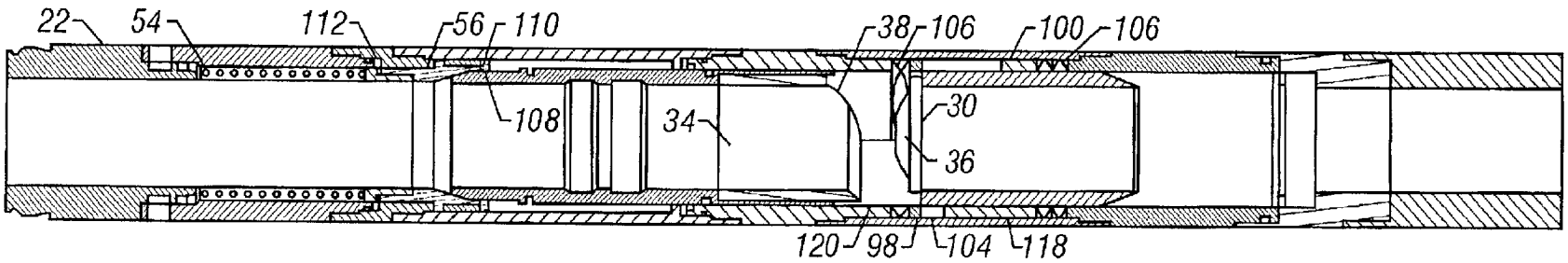
Figure 10C:
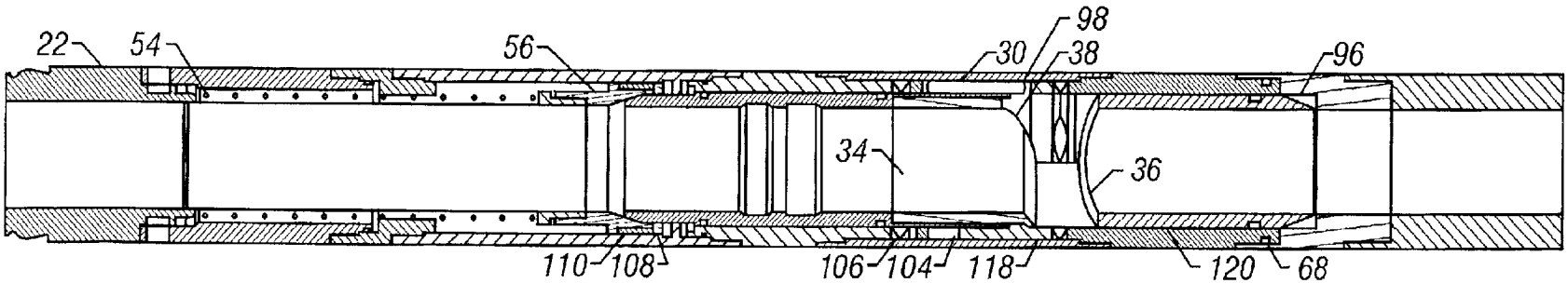

FIGS. 10A, 10B and 10C show an alternate embodiment of the present invention.

FIG. 10A illustrates the valve apparatus 22 in its initial open configuration where the sliding sleeve 34 is in its lower position and the contact surface 38 is holding the valve member 30 in its open position. In this embodiment the sliding sleeve 34 is held in its initial lower position by a shear element 114 that joins the sliding sleeve 34 to the housing member 24. A compressed C-ring 86 is also shown that acts to prevent the sliding sleeve 34 and the seat 36 subassembly from moving downwards. The C-ring 86 can allow an upward movement of the sliding sleeve 34, in which the C-ring 86 expands to its un-compressed state in a recess 116 within the housing 24 located just above the original compressed C-ring 86 location. The flapper subassembly 100 is disposed within the housing 24 and two wave springs 106 are shown on the ends of the flapper subassembly 100. The flapper subassembly 100 is capable of slight longitudinal movement within the housing 24. The wave springs 106 urge the flapper subassembly 100 to the middle of this movement length. The sliding sleeve 34 further comprises a profile 108 that is capable of attachment with the spring sleeve 56. The sliding sleeve 34 assembly (which includes the seat 36 subassembly) and the flapper subassembly 100 are capable of rotational movement within the housing 24.

A rotational link exists between the sliding sleeve 34 assembly (which includes the seat 36 subassembly) and the flapper subassembly 100. The term rotational link is used within the current application to refer to a connection of two bodies such that the rotational movement of one body will cause the rotational movement of both bodies. In the present embodiment the rotational link comprises a guide 118 within the flapper subassembly 100 that is disposed within a longitudinal groove 120 that exists within the wall of the sliding sleeve 34 assembly. In this embodiment the sliding sleeve 34 and the flapper subassembly 100 are both capable of rotational movement within the housing 24, but are always aligned in proper rotational position in relation to each other through the rotational linkage. In this way the seat 36 and valve member 30 are kept in proper alignment with each other and are capable of forming a seal when in contact.

FIG. 10B illustrates the valve apparatus 22 in its closed configuration after the sliding sleeve 34 has been moved into its upper position. The tail 98 of the valve member 30 is in contact with the valve stop 104, restricting further rotational movement of the valve member 30. The seating element 36 is in contact with the valve member 30 and capable of forming a seal that restricts fluid communication through the valve apparatus 22. The seating element 36 and valve member 30 are in rotational alignment due to the rotational linkage between the flapper subassembly 100 and the sliding sleeve 34 assembly discussed above. The profile 108 of the sliding sleeve 34 engages with a C-ring 110 that is connected to the spring sleeve 56. The spring sleeve 56 is retained in its upper position within the housing 24 by a shear ring 112. The ability of the flapper subassembly 100 to move longitudinally within the housing 24 enables the valve member 30 to lift off of the seat 36 if there is force exerted from below the valve member 30 that is greater than the force exerted from above the valve member 30.

FIG. 10C shows the valve apparatus 22 in its final open configuration. A force exerted on the sliding sleeve 34 breaks the shear ring 112 that is retaining the spring sleeve 56, allowing the movement to the position of FIG. 10C. This force can result from imposing a pressure differential across the valve member 30 or by other means such as mechanical jars run on wireline or coiled tubing. The breaking of the shear ring 112 enables the spring element 54 to move the spring sleeve 56 to its lower position. The spring sleeve 56 remains attached to the C-ring 110 which itself is attached to the profile 108 of the sliding sleeve 34. The sliding sleeve 34 moves to its lower position with assistance from the spring element 54. As the sliding sleeve 34 moves downward, the contact surface 38 contacts and opens the valve member 30 to the fully open position. Once the sliding sleeve 34 is in its lower position, it is held in this final position by engaging with the retaining ring 68 and by the force imposed from the spring element 54. Further downward movement of the sliding sleeve 34 is prevented by a positive stop 96. The valve apparatus 22 remains in this final open configuration until removed from the wellbore 10.

Possible applications of the present invention include utilizing multiple valve assemblies in tandem to allow operations to be performed on numerous zones. A particular zone can be completed, followed by isolation of this zone, prior to commencing operations on a different zone. Other uses can include the isolation of multiple zones or lateral extensions of a wellbore, thus allowing the selective production of each zone at a time determined by reservoir characteristics. Criteria used to determine the sequence of producing from various zones include formation pressures, production rates that can be economically produced and the ultimate recovery that is anticipated from each zone completed in the well.

One particular application of the present invention is to prevent the completion fluids inside the wellbore from being lost into the formation. Once a zone has been completed, particularly with completions utilizing sand control methods such as gravel packing, there may no longer be a filter cake on the formation face with sufficient integrity to hold the hydrostatic pressure in the wellbore. Completion fluids within the wellbore can leak off into the formation in a process commonly known as "fluid loss". The loss of completion fluids can lead to the reduction of hydrostatic pressure on the completed zone, enabling the wellbore to fill with formation fluids and, if not contained, release into the atmosphere. If fluid loss occurs when completion activities are in operation, such as completing another zone, pulling a work string out of the well or running a production string in the well, there is the chance of losing well control and potentially experiencing a blow-out. In some instances completion activities can be performed while fluid is continually added to the wellbore to maintain a hydrostatic head on the formation, but this method increases the time, equipment and expense required. Injecting additional fluids may also have harmful effects on the producing formation, such as the swelling of water sensitive clays or introducing contaminants such as sulfide reducing bacteria. With the present invention the valve element 30 is closed when the lowest portion of the work string is pulled from the valve apparatus 22. Once the valve member 30 is closed, the completion fluid in the wellbore above the valve member 30 is contained, thereby preventing the well control problems caused by fluid loss.

Another use for the present invention is as a disappearing plug. In this application the valve apparatus is located below a packer in a production string. The valve is run in the closed position, such as in FIGS. 2B and 3B, allowing the production string to be filled with completion fluid. Once the production string is in place, the packer can be set utilizing pressure within the production tubing high enough to set the packer, but not high enough to cause the valve apparatus to open. Once the packer is set, elevated pressure can be applied on the annulus between the production tubing and the wellbore casing to insure that the packer was successfully set. After testing the packer, the pressure within the production tubing can be increased to a level where the valve apparatus will open, as shown in FIGS. 2C and 3C. The completion will then be ready to produce formation fluids. This application of the present invention allows the completion to be performed, the packer to be set with tubing pressure, and the valve to be opened without any intervention trips such as would be required when running a wireline retrievable plug.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for use in completing a subterranean zone penetrated by a wellbore, comprising:

a housing member having a longitudinal bore and an inner diameter;

a valve member disposed within the housing member and movable between an open position and a closed position;

a sliding sleeve disposed within the housing member having a longitudinal bore, movable between an upper position and a lower position, and having an upwardly facing seating element on which the valve member can seat;

wherein when the sliding sleeve is in the lower position, the valve member is held in the open position and communication is established between the longitudinal bore of the housing above the valve member and the longitudinal bore of the housing below the valve member; and wherein when the sliding sleeve is in the upper position, the valve member is held in the closed position and communication between the longitudinal bore of the housing above the valve member and the longitudinal bore of the housing below the valve member is restricted.

2. The apparatus of claim 1, wherein the seating element is circular and is disposed within the longitudinal bore of the housing member and comprises an elastomeric sealing element.

3. The apparatus of claim 1, wherein the sliding sleeve further comprises a contact surface that contacts the valve member and restrains the valve member in the open position when the sliding sleeve is in the lower position.

4. The apparatus of claim 3, wherein the valve member comprises a flapper type valve hinged on one side and a torsion spring member that urges the valve member towards a location between the open position and the closed position; wherein when the sliding sleeve is in the upper position, the torsion spring member urges the valve member to seat onto the seating element; and wherein when the sliding sleeve is between the upper position and the lower position and the contact surface is not in contact with the valve member, the torsion spring member urges the valve member to be located between the open position and to protrude into the longitudinal bore.

5. The apparatus of claim 1, wherein the housing member comprises a first segment and a second segment, the first segment having a smaller inner diameter than the second segment and wherein the valve member is disposed within the second segment of the housing member.

6. The apparatus of claim 5, wherein when the valve member is in the open position, the opening through the longitudinal bore of the second segment is at least as large as the inner diameter of the first segment.

7. An apparatus for use in completing a subterranean zone penetrated by a wellbore, comprising:

a housing member having a longitudinal bore and an inner diameter;

a valve member disposed within the housing member and movable between an open position and a closed position;

a sliding sleeve disposed within the housing member having a longitudinal bore, movable between an upper position and a lower position, and having a seating element on which the valve member can seat; and a spring element disposed within the housing, movable between a compressed position and an expanded position, that urges the sliding sleeve into the lower position, wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position and communication between the longitudinal bore of the housing above the valve member and the longitudinal bore of the housing below the valve member is restricted; and wherein when the sliding sleeve is in the upper position, the spring element is in the compressed position.

8. The apparatus of claim 7, further comprising:

a spring sleeve disposed within the housing, movable between an upper position and a lower position, urged toward the lower position by the spring element;

wherein the spring sleeve is held in the upper position by at least one shear element that connects the spring sleeve to the housing member.

9. The apparatus of claim 8, wherein the sliding sleeve further comprises a linking element and wherein when the sliding sleeve is in the upper position the linking element is attached to the spring sleeve.

10. The apparatus of claim 9, wherein when the sliding sleeve is in the upper position, the spring sleeve is in the upper position, and the linking element is attached to the spring sleeve, a downward force can be exerted on the sliding sleeve that will move the sliding sleeve downward, causing downward force on the spring sleeve and forcing the shear element to break and disconnect the spring sleeve from the housing member.

11. The apparatus of claim 10, wherein when the spring sleeve is disconnected from the housing member the spring element urges the sliding sleeve towards its lower position.

12. An apparatus for use in completing a subterranean zone penetrated by a wellbore, comprising:

a housing member having a longitudinal bore and an inner diameter;

a valve member disposed within the housing member and movable between an open position and a closed position;

a sliding sleeve disposed within the housing member having a longitudinal bore, movable between an upper position and a lower position and having a seating element on which the valve member can seat; and a mandrel element, capable of being in an upper position and a lower position, disposed within the longitudinal bore of the housing and rigidly connected to the sliding sleeve, wherein when the sliding sleeve is in the lower position, the valve member is held in the closed position and communication between the longitudinal bore of housing above the valve member and the longitudinal bore of the housing below the valve member is restricted.

13. The apparatus of claim 12, further comprising:

a shear sleeve member disposed within the longitudinal bore of the housing and capable of being in an upper position and a lower position, the shear sleeve member further comprising at least one locking element and at least one shear element;

wherein when the sliding sleeve is in the upper position, the locking element prevents the shear sleeve member from moving longitudinally relative to the housing member.

14. The apparatus of claim 13, further comprising:

a latching element connected to the sliding sleeve and to the mandrel element, disposed within the longitudinal bore of the housing and capable of being in latched or unlatched configuration and in an upper position and a lower position;

wherein the latching element is connected to the shear sleeve member with at least one shear element.

15. The apparatus of claim 14, wherein when the shear sleeve member is in its upper position and the latching element is in its upper position and connected to the shear sleeve member, a downward force can be exerted on the mandrel element that will move the mandrel element downward, causing the mandrel element to contact the latching element and forcing the shear element to break and disconnect the latching element from the shear sleeve member.

16. The apparatus of claim 15, wherein when the latching element is disconnected from the shear sleeve member and is in its lower position, the latching element is in its latched configuration and unable to move longitudinally relative to the housing member, the sliding sleeve will be in its lower position and unable to move longitudinally relative to the housing member, and the valve member will be in its open position.

17. An apparatus for use in completing a subterranean zone penetrated by a wellbore, comprising:

a housing member having a longitudinal bore and an inner diameter;

a valve member disposed within the housing member and movable between an open position and a closed position; and a sliding sleeve disposed within the housing member having a longitudinal bore, movable between an upper position and a lower position, and having a seating element on which the valve member can seat, wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position and communication between the longitudinal bore of the housing above the valve member and the longitudinal bore of the housing below the valve member is restricted; and wherein the valve member comprises a disk having a concave surface on one side and a convex surface on the other side.

18. An apparatus for use in completing a subterranean zone penetrated by a wellbore, comprising:

a housing member having a longitudinal bore and an inner diameter;

a valve member disposed within the housing member and movable between an open position and a closed position; and a sliding sleeve disposed within the housing member having a longitudinal bore, movable between an upper position and a lower position and having a seating element on which the valve member can seat, wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position by the sliding sleeve and communication between the longitudinal bore of the housing above the valve member and the longitudinal bore of the housing below the valve member is restricted; and wherein the valve member is connected to a collar element, the housing member further comprises a collar groove, the collar element is housed within the collar groove and the collar element comprises a collar notch to prevent the collar element from rotating within the collar groove.

19. An apparatus for use in completing a subterranean zone penetrated by a wellbore, comprising:

a housing member having a longitudinal bore and an inner diameter;

a valve member disposed within the housing member and movable between an open position and a closed position; and a sliding sleeve disposed within the housing member having a longitudinal bore, movable between an upper position and a lower position, and having a seating element on which the valve member can seat, wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position and communication between the longitudinal bore of the housing above the valve member and the longitudinal bore of the housing below the valve member is restricted; and wherein the housing member further comprises a retaining ring that engages with the sliding sleeve when the sliding sleeve is in the lower position and restrict movement of the sliding sleeve when engaged.

20. An apparatus for use in completing a subterranean zone penetrated by a wellbore, comprising:

a housing member having a longitudinal bore and an inner diameter;

a valve member disposed within the housing member and movable between an open position and a closed position; and a sliding sleeve disposed within the housing member having a longitudinal bore, movable between an upper position and a lower position, and having a seating element on which the valve member can seat, wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position and communication between the longitudinal bore of the housing above the valve member and the longitudinal bore of the housing below the valve member is restricted; and wherein:

the sliding sleeve further comprises a key slot, the key slot comprising an upper key stop and a lower key stop;

the housing member further comprises a key element that is located within the key slot and restricts the sliding sleeve from rotating;

when the sliding sleeve is in its upper position, the key element will contact the lower key stop to restrict further upward movement of the sliding sleeve, and the valve element will be in its closed position; and when the sliding sleeve is in its lower position, the key element will contact the upper key stop to restrict further downward movement of the sliding sleeve, and the valve element will be in its open position.

21. An apparatus for use in completing a subterranean zone penetrated by a wellbore, comprising:

a housing member having a longitudinal bore and an inner diameter;

a valve member disposed within the housing member and movable between an open position and a closed position; and a sliding sleeve disposed within the housing member having a longitudinal bore, movable between an upper position and a lower position, and having a seating element on which the valve member can seat, wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position and communication between the longitudinal bore of the housing above the valve member and the longitudinal bore of the housing below the valve member is restricted; and wherein the valve member has a projection, the projection capable of restricting the rotational movement of the valve member to movement between the open position and the closed position.

22. An apparatus for use in completing a subterranean zone penetrated by a wellbore, comprising:

a housing member having a longitudinal bore and an inner diameter;

a valve member disposed within the housing member and movable between an open position and a closed position; and a sliding sleeve disposed within the housing member having a longitudinal bore, movable between an upper position and a lower position, and having a seating element on which the valve member can seat.

wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position and communication between the longitudinal bore of the housing above the valve member and the longitudinal bore of the housing below the valve member is restricted; and wherein the valve member is disposed within and connected to a valve housing, thereby creating a valve subassembly, the valve subassembly disposed within the housing.

23. The apparatus of claim 22, wherein the valve subassembly is capable of rotational movement within the housing.

24. The apparatus of claim 22, wherein the valve subassembly is capable of limited longitudinal movement within the housing.

25. The apparatus of claim 24, wherein when the valve member is in its closed position, the valve subassembly is capable of longitudinal movement within the housing.

26. The apparatus of claim 25, wherein the valve subassembly is capable of moving the valve member away from the seating element, thereby enabling fluid communication through the apparatus.

27. The apparatus of claim 26, wherein the valve subassembly is capable of moving the valve member away from the seating element upon a force exerted from below the valve member.

28. The apparatus of claim 22, wherein the sliding sleeve is capable of rotational movement within the housing.

29. The apparatus of claim 22, wherein the valve subassembly and the sliding sleeve are rotationally linked.

30. The apparatus of claim 29, wherein the valve subassembly comprises a guide, the sliding sleeve comprises a groove, and the guide is disposed within the groove creating a rotational linkage between the sliding sleeve and the valve subassembly.

31. An apparatus for use in completing a subterranean zone penetrated by a wellbore comprising:

a housing member having a longitudinal bore, an inner diameter, a first segment and a second segment, the first segment having a smaller inner diameter than the second segment;

a valve member disposed within the second segment of the housing member and movable between an open position and a closed position, hinged on one side and having a torsion spring member that urges the valve member towards a location between the open position and the closed position;

a sliding sleeve disposed within the housing member having a longitudinal bore and movable between an upper position and a lower position, having a seating element on which the valve member can seat and having a contact surface that contacts the valve member and restrains the valve member in the open position when the sliding sleeve is in the lower position;

a spring element disposed within the longitudinal bore of the housing, movable between a compressed position and an expanded position, that urges the sliding sleeve into its lower position;

a mandrel element disposed within the longitudinal bore of the housing, capable of being in an upper position and a lower position and connected to the sliding sleeve;

a shear sleeve member disposed within the longitudinal bore of the housing and capable of being in an upper position and a lower position, the shear sleeve member comprising at least one locking element and at least one shear element;

a latching element disposed within the longitudinal bore of the housing, connected to the sliding sleeve and to the mandrel element, capable of being in a latched configuration and an unlatched configuration, and capable of being in an upper position and a lower position, and connected to the shear sleeve member by at least one shear element;

wherein when the sliding sleeve is in the lower position, the valve member is held in the open position and communication is established between the longitudinal bore of the housing above the valve member and the longitudinal bore of the housing below the valve member;

wherein when the sliding sleeve is in the upper position, the valve member is held in the closed position and communication between the longitudinal bore of the housing above the valve member and the longitudinal bore of the housing below the valve member is restricted;

wherein when the shear sleeve member is in its upper position, the locking element prevents the shear sleeve member from moving longitudinally relative to the housing member;

wherein when the shear sleeve member is in its upper position and the latching element is in its upper position and connected to the shear sleeve element, downward force can be exerted on the mandrel element, the mandrel element movement will contact the latching element and will force the shear element to break and disconnect the latching element from the shear sleeve member; and wherein when the latching element is disconnected from the shear sleeve member and is in its lower position, the latching element is in its latched configuration and unable to move longitudinally relative to the housing member, the sliding sleeve is in its lower position and unable to move longitudinally relative to the housing member, and the valve member is in its open position.

32. An apparatus for use in completing a subterranean zone penetrated by a wellbore comprising:

a housing member having a longitudinal bore, an inner diameter and comprising a retaining ring and a key element;

a valve member disposed within the housing member and movable between an open position and a closed position, having a torsion spring member that urges the valve member towards a location between the open position and the closed position;

a sliding sleeve disposed within the housing member having a longitudinal bore and movable between an upper position and a lower position, comprising a seating element on which the valve member can seat, a key slot that is in sliding contact with the key element and restricts the sliding sleeve from rotating within the housing member, and a contact surface that contacts the valve member and restrains the valve member in the open position when the sliding sleeve is in the lower position;

a spring sleeve disposed within the longitudinal bore of the housing, capable of moving between an upper position and a lower position, the spring sleeve comprising at least one shear element;

a spring element disposed within the longitudinal bore of the housing, movable between a compressed position and an expanded position, that urges the spring sleeve into its lower position;

a linking element disposed within the longitudinal bore of the housing, the linking element being connected to the sliding sleeve;

wherein when the sliding sleeve is in the lower position, the retaining ring prevents the shear sleeve member from moving longitudinally relative to the housing member, the valve member is held in the open position and communication is established between the longitudinal bore of the housing above the valve member and the longitudinal bore of the housing below the valve member;

wherein when the sliding sleeve is in the upper position, the sliding sleeve is attached to the spring sleeve by the linking element, the valve member is held in the closed position and communication between the longitudinal bore of the housing above the valve member and the longitudinal bore of the housing below the valve member is restricted;

wherein when the sliding sleeve is in its upper position and the linking element is in its upper position and connected to the spring sleeve, a downward force can be exerted on the sliding sleeve, the sliding sleeve movement will force the shear element to break and disconnect the spring sleeve from the housing member; and wherein when the spring sleeve is disconnected from the housing member and is in its lower position, the linking element is attached to the sliding sleeve, the sliding sleeve is in its lower position unable to move longitudinally relative to the housing member, and the valve member is in its open position.

33. An apparatus comprising:

a valve member comprising a disk having a concave surface on one side and a convex surface on the other side;

a collar element having a longitudinal bore therethrough; and wherein the valve member is hingedly connected to the collar element and movable between an open position and a closed position.

34. The apparatus of claim 33, wherein the valve member comprises a torsion spring member that urges the valve member towards a location between the open position and closed position.

35. The apparatus of claim 33, further comprising orienting notch on the outer diameter of the collar element.

36. A method for completing a subterranean zone penetrated by a wellbore, comprising:

providing an apparatus comprising a housing member having a longitudinal bore and an inner diameter, a valve member disposed within the housing member movable between an open position and a closed position, a sliding sleeve dispose within the housing member having a longitudinal bore and movable between an upper position and a lower position and having a seating element on which the valve member can seat, a mandrel element capable of being in an upper position and a lower position, a shear sleeve member capable of being in an upper position and a lower position and including at least one shear element, a latching element capable of being in a latched or unlatched configuration, wherein when the sliding sleeve is in the lower position, the valve member is held in the open position and communication is established between the longitudinal bore of the housing above the valve member and the longitudinal bore of the housing below the valve member, and wherein when the sliding sleeve is in the upper position, the valve member is held in the closed position and communication between the longitudinal bore of the housing above the valve member and the longitudinal bore of the housing below the valve member is restricted;

positioning the apparatus within the wellbore with the sliding sleeve in the lower position holding the valve member open;

moving the sliding sleeve to its upper position, whereby the valve member is held in its closed position and communication through the longitudinal bore of the housing is restricted; and imposing a force on at least one of the sliding sleeve or mandrel element such that the mandrel element transmits the force onto the shear element, breaks the shear element and allows the sliding sleeve to move to its lower position, thereby opening the valve member and allowing communication through the longitudinal bore of the housing.

37. The method of claim 36, further comprising:

attaching a gravel pack screen assembly, a packer and a work sting to the apparatus prior to positioning the apparatus within the wellbore;

setting the packer and flowing a gravel laden slurry through the work string, packer and apparatus and placing the slurry between the wellbore and the gravel pack screen assembly while the valve member is held in its open position; and disconnecting the work string from the apparatus and packer after the travel laden slurry has been placed, shifting the sliding sleeve to its upper position and thereby holding the valve member in its closed position.

38. A method for completing a subterranean zone penetrated by a wellbore, comprising:

providing an apparatus comprising a housing member having a longitudinal bore and an inner diameter, a valve member disposed within the housing member movable between an open position and a closed position, a sliding sleeve disposed within the housing member having a longitudinal bore and movable between an upper position and a lower position and having a seating element on which the valve member can seat, a spring element disposed within the housing, movable between a compressed position and an expanded position, a spring sleeve movable between an upper position and a lower position, and including at least one shear element, wherein when the sliding sleeve is in the lower position, the valve member is held in the open position and communication is established between the longitudinal bore of the housing above the valve member and the longitudinal bore of the housing below the valve member, and wherein when the sliding sleeve is in the upper position, the valve member is held in the closed position and communication between the longitudinal bore of the housing above the valve member and the longitudinal bore of the housing below the valve member is restricted;

positioning the apparatus within the wellbore with the sliding sleeve the lower position holding the valve member open;

moving the sliding sleeve to its upper position, whereby the valve member is held in its closed position and communication through the longitudinal bore of the housing is restricted; and imposing a force on the sliding sleeve such that the sliding sleeve transmits the force onto the shear element, breaks the shear element and allows the sliding sleeve to move to its lower position, thereby opening the valve member and allowing communication through the longitudinal bore of the housing.

39. The method of claim 38, further comprising:

attaching a gravel pack screen assembly, a packer and a work string to the apparatus prior to positioning the apparatus within the wellbore;

setting the packer and flowing a gravel laden slurry through the work string, packer and apparatus and placing the slurry between the wellbore and the gravel pack screen assembly while the valve member is held in its open position; and disconnecting the work string from the apparatus and packer after the gravel laden slurry has been placed, shifting the sliding sleeve to its upper position and thereby holding the valve member in its closed position.

40. A method for completing a subterranean zone penetrated by a wellbore, wherein a completion string is located within the wellbore, comprising:

providing an apparatus comprising a flapper type valve within the completion string, wherein the flapper type valve is movable between an open position and a closed position;

engaging the flapper valve with a sliding sleeve to close the flapper valve after completion operations have been performed;

selectively locking the flapper valve in the closed position;

selectively releasing the flapper valve to the open position.

41. The method of claim 40, wherein the completion string is initially connected to a tubular string, further comprising the step of disconnecting the tubular string from the completion string and removing the tubular string from the wellbore after selectively locking the flapper valve in the closed position.

42. The method of claim 40, further comprising increasing the pressure in the wellbore to release the flapper valve.

43. The method of claim 40, further comprising increasing the pressure in the completion string to release the flapper valve.

44. The method of claim 40, wherein an annulus exists between the completion string and the wellbore wall, further comprising increasing the pressure in the completion string-wellbore annulus to release the flapper valve.

45. The method of claim 40, further comprising hearing at least one shear element to release the flapper valve.

46. The method of claim 40, wherein the flapper valve seals from below.

47. An apparatus for completing a subterranean zone penetrated by a wellbore in which a completion string is located, comprising:

a flapper valve disposed within the completion string movable between an open position and a closed position;

a sliding sleeve capable of selectively engaging and closing the flapper valve; and means for selectively locking the flapper valve in the closed position, such that the flapper valve may be subsequently selectively released to the open position.

48. An apparatus, according to claim 47, where the sliding sleeve is further capable of selectively engaging and reopening the flapper valve.

49. An apparatus, according to claim 47, further comprising means for latching the flapper valve in the open position.

50. An apparatus, according to claim 47, further comprising a biasing member for urging the sliding sleeve toward a lower position.

51. An apparatus for completing a subterranean zone penetrated by a wellbore in which a completion string is located, comprising:

a flapper valve disposed within the completion string movable between an open position and a closed position;

a sliding sleeve capable of selectively engaging and closing the flapper valve; and a locking member capable of selectively locking the flapper valve in the closed position, such that the flapper valve may be subsequently selectively released to the open position.

* * * * *